United States Patent [19]

Schreyer

[11] 3,999,819

[45] Dec. 28, 1976

[54] FILLING FOLDERS AND DIVIDERS

[76] Inventor: Kenneth D. Schreyer, 5130 Brookhaven Drive, Clarence, N.Y. 14031

[22] Filed: Apr. 30, 1975

[21] Appl. No.: 573,093

[52] U.S. Cl. ..... 312/184; 312/183; 402/4; 229/1.5 R; 40/102

[51] Int. Cl.[2] ..... B42F 3/00; A47B 63/00

[58] Field of Search ..... 312/184, 183, 193, 189; 402/3; 4, 62, 70, 502, 1 BB; 211/50; 229/1.5 R; 40/102

[56] References Cited

UNITED STATES PATENTS

| | | | |
|---|---|---|---|
| 506,802 | 10/1893 | Stowe | 40/17 |
| 1,122,311 | 12/1914 | Saxton | 211/50 |
| 1,749,376 | 3/1930 | DeLisle | 229/41 |
| 1,917,980 | 7/1933 | Kelsey | 312/183 |
| 2,523,722 | 9/1950 | Saaf et al. | 402/502 |
| 2,578,252 | 12/1951 | Kolbl | 211/50 |
| 3,086,658 | 4/1963 | Palmer | 211/50 |
| 3,892,451 | 7/1975 | Bruins | 312/183 |

FOREIGN PATENTS OR APPLICATIONS

| | | | |
|---|---|---|---|
| 158,107 | 8/1954 | Australia | 312/184 |
| 590,404 | 1/1960 | Canada | 312/183 |
| 958,829 | 2/1957 | Germany | 312/184 |

*Primary Examiner*—Paul R. Gilliam
*Assistant Examiner*—Victor N. Sakran
*Attorney, Agent, or Firm*—Bean & Bean

[57] ABSTRACT

File folders and filing cabinet drawer dividers (as will be referred to hereinafter as "separators") made of relatively thin and inexpensive paper stock which are vertically reinforced by an improved stiffening means which also furnishes (or reinforces) the conventional type upstanding file contents identification device, and which include folded-over upper end portions which further reinforce the identification "tab" against bending/wear stresses. The folded-over portion is also so formed as to provide a rearwardly extending abutment which acts to space apart like separators when adjacently disposed in a filing drawer or the like. Thus, the separators are with improved facility individually identifiable and grasped by the user for withdrawal purposes; as well as being relatively inexpensive to maufacture while being of improved stiffness in requisite respects. The separators of the divider type are similarly vertically reinforced and include means for reinforcing both the upper identification tab portion and the bottom tab portions which engage with the conventional type file drawer divider hold-down or "follower rod".

8 Claims, 11 Drawing Figures

30
31
18
32
25

3
24
30
32
22
3
18
28
28
4
14
12
25
4
26
16
16
12
18
28
25

26
28
20
24
30
32

31
24
32
22
18
20
6
18
25
6

31

18
25
31
34
18
36
25
38
40
42

FILLING FOLDERS AND DIVIDERS

My invention relates to filing material separators such as are used for example in conjunction with typical office filing cabinets, shelves, and the like. It is to be understood that the term "separators" refers to devices such as are employed to set apart variously indexed and/or otherwise segregated correspondence, literature, and the like. As illustrated and described in detail herein, the reinforcement arrangement of my invention may be embodied in otherwise conventional types of file folders and dividers, and the like. It is especially concerned with vertical reinforcement means for the panel portion of a separator which may be made of relatively thin and inexpensive sheet paperlike stock materials, and which also reinforces the upper edge and/or identification tab portion thereof to prolong the wear capabilities thereof and to resist tearing or "dog-earing" thereof.

Another feature of my invention is concerned with providing at the upper rear side portion of such a separator an abutment which spaces-apart adjacently filed separators. This feature, in connection with a "folder" type separator provides that although the front cover portion of the folder is relatively limp and therefore adapted to accommodate "expansion" requirements according to the volume of material to be filed in the folder, contributes to prevention of any undesirable obscurement of the folder identification device which is carried by the rear panel portion of the folder. Thus the folders are with improved facility individually identifiable and grasped by the user for withdrawal purposes. A further feature of my invention provides as well for reinforcing the apertured bottom tab portion of a separator of the filing drawer "divider" type such as engages the conventional type "follower rod" which is typically furnished with each filing cabinet drawer.

The foregoing, together with further objects, features and advantages of my invention are set forth in the following description of several embodiments thereof, as are illustrated in the accompanying drawing wherein.

Figures 1, 2, 3, 4, 5, 6, 7:
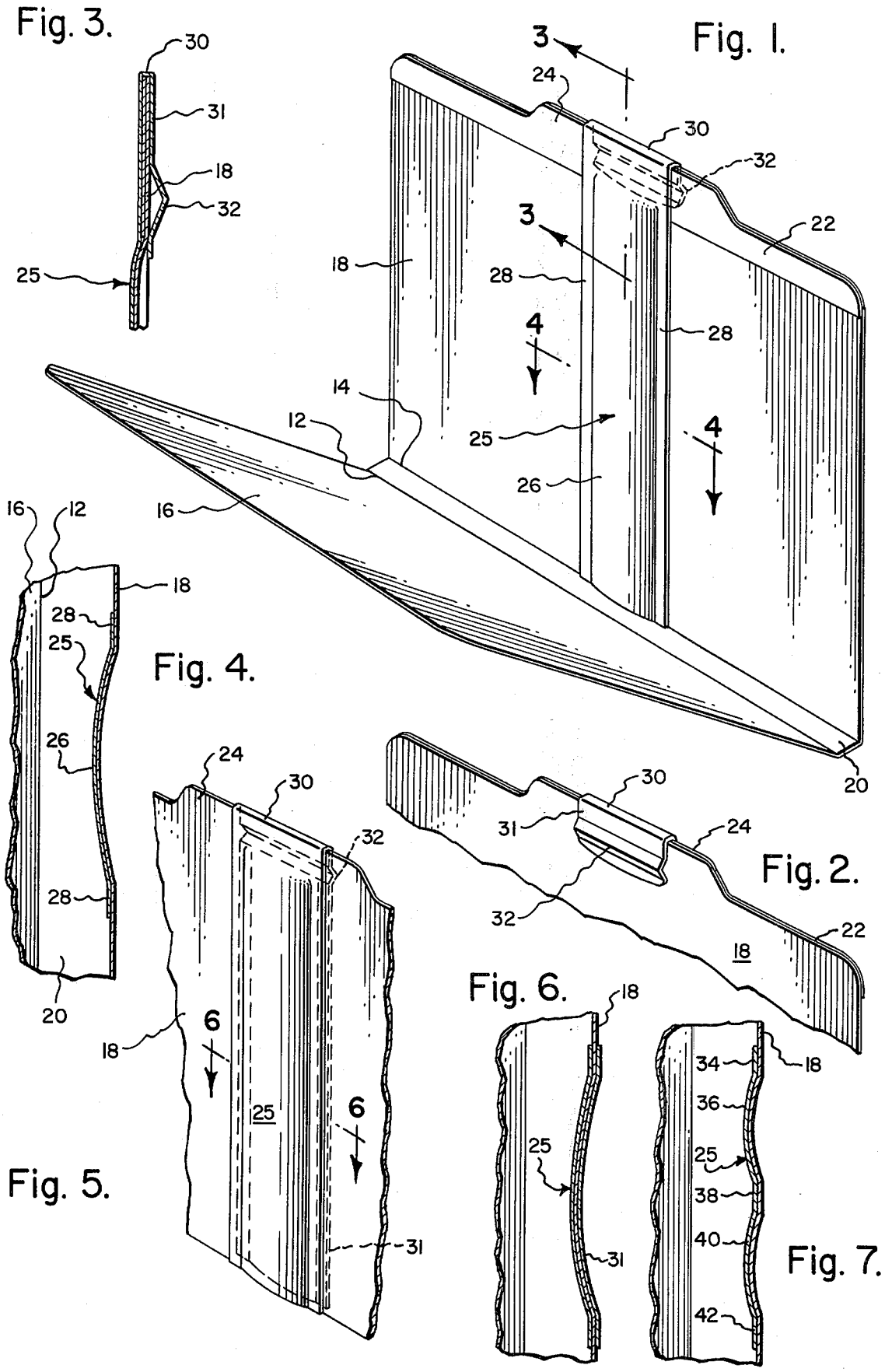
FIG. 1 is a perspective view showing one form of my folder in an empty, open condition.
FIG. 2 is a fragmentary reverse side view of the upper identification "index" tab portion of the folder of FIG. 1.
FIG. 3 is a fragmentary enlarged scale sectional view taken as suggested along line 3—3 of FIG. 1.
FIG. 4 is a fragmentary enlarged scale sectional view taken as suggested along line 4—4 of FIG. 1.
FIG. 5 is a fragmentary view corresponding to a portion of FIG. 1, but showing a modified form of reinforcement device.
FIG. 6 is an enlarged scale fragmentary sectional view taken as suggested by line 6—6 of FIG. 5.
FIG. 7 is a view corresponding to FIG. 6 but showing use of a modified form of reinforcement device.
Figure 9:
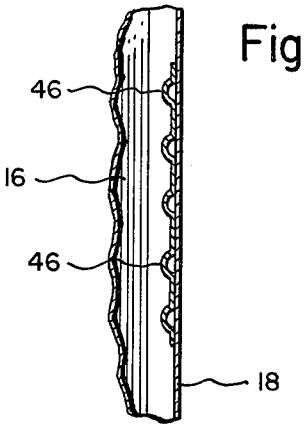
Figure 8:
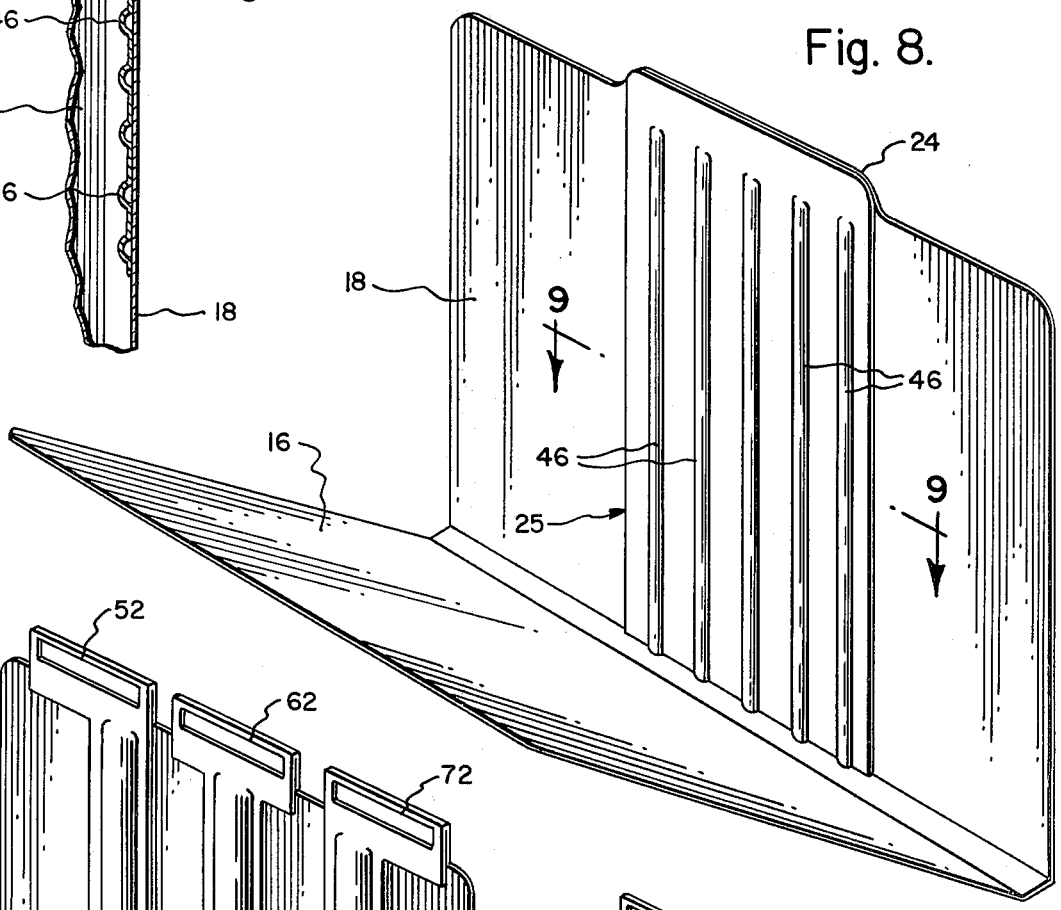
Figure 10:
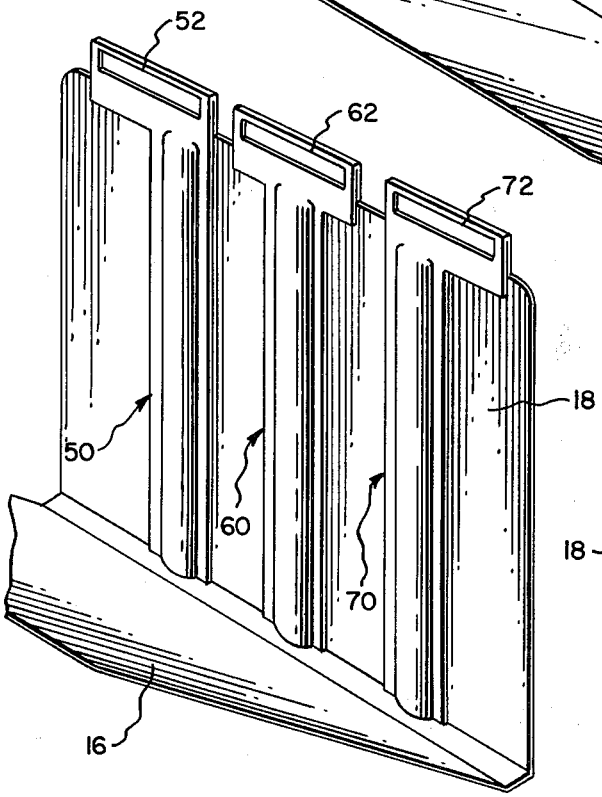
Figure 11:
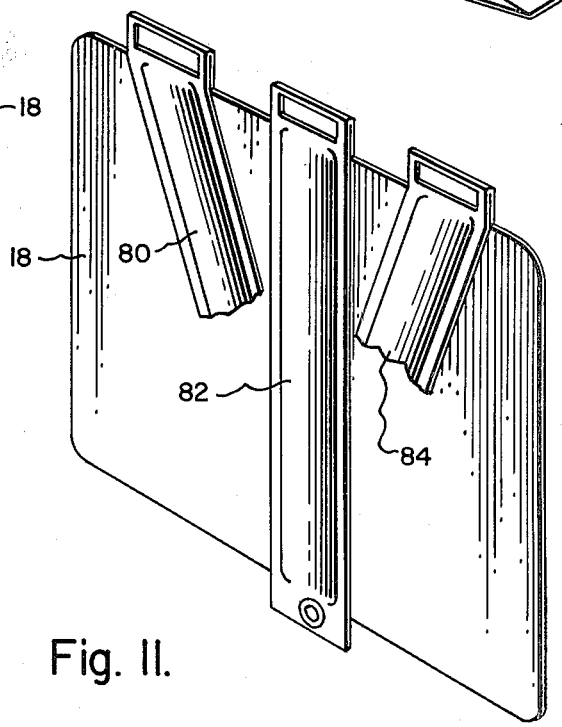

FIG. 8 corresponds to FIG. 1, but illustrates use of still another form of reinforcement;

FIG. 9 is a fragmentary sectional view taken as suggested by line 9—9 of FIG. 8; and FIGS. 10 and 11 correspond to FIGS. 1 and 8, but show still further modified forms of the reinforcing device.

As illustrated by way of example at FIGS. 1–4, the body portion of the file folder of my invention may be made of relatively thin and inexpensive paper stock; being folded as indicated at 12, 14 (FIG. 1) so as to provide a front cover portion 16; a rear panel portion 18; and a flat bottom portion 20 so as to provide a suitable pocket into which material to be filed may be slip-fitted. As illustrated at 22, the upper edge portions of such rear panel portions may be reinforced by a complementary shaped paper or cardboard piece, as is well known in the art. In any case the upper edge of the rear panel 18 is typically shaped so as to provide an upstanding identification or "index tab" portion 24.

One form of reinforcement device in accordance with my invention is illustrated generally at 25, and comprises a strap formed of relatively stiff but yet resilient sheet material, such as of spring metal; spring plastic; or any other springy type sheet material. Also, by way of example, as best shown at FIGS. 1, 4, the member 25 may comprise an arcuately sectioned resilient "spring-set" central body portion 26 margined at its opposite sides with co-planar flange portions 28—28. The flange portions 28—28 are adhesively or otherwise affixed to the rear panel 18. Optionally, as shown at FIG. 4 the portion of the rear panel 18 coextensive with the arcuate section 26 of the reinforcing member may also be adhesively affixed to the reinforcing member. If an adhesive is to be employed it will of course be selected so as to be fully compatible for its intended purpose with the materials from which the folder panel and the reinforcing member are fabricated.

At the upper edge of the folder the reinforcing member is fabricated so as to be "pre-set" into flat sectioned form as shown, and is bent over the top of the index tab portion 24 as shown at 30, and then rearwardly and downwardly behind the upper portion of the panel 18 as indicated at 31; so as to further reinforce the upper edge of the folder which receives the normal wear and tear duing usage of the folder.

As shown at FIGS. 1–3, the downwardly extending portion of the reinforcing member is "set" in a sectionally deformed condition so as to provide a rearwardly extending projection designated 32 which thereupon functions to provide a convenient hand-hold for the user to facilitate withdrawal of the folder from a filing cabinet or the like. This projection lso functions to space-apart adjacently filed folders in a filing cabinet or the like, thereby further facilitating visual recognition/-separation and withdrawal of the desired folder when reposing in a filing drawer. It is by virtue of this feature and of the fact that the front panel portion of the folder is relatively limp in vertical direction and is therefore adapted to retract downwardly while the folder accommodates insertion of filing material, that the reinforced rear panel portion carrying the index tab invariably stands up to its full height and in clear view behind the folder contents. Thus the folders are with improved facility individually identifiable and/or grasped by the user for withdrawal purposes.

FIGS. 5, 6, illustrate a modified form of the reinforcing member which is somewhat similar to the construction shown in FIGS. 1–4 but differs therefrom in that the reinforcing member continues to extend downwardly behind the panel 18 to substantially the bottom portion of the folder. As shown, the downwardly extending rearward portion of the reinforcing member may be similarly adhesively or otherwise affixed to the folder panel 18; and thus it will be appreciated that any desired additional degree of vertical stiffness may be provided for the folder rear panel 18.

FIG. 7 illustrates another modified form of the reinforcing device of the invention wherein the reinforcing member 25 is fabricated in vertically corrugated sectional form. Thus, the reinforcing member comprises (in horizontal sectional form) a side-from-side succession of portions including, an edge flange 34; a first curved section 36; a centrally located flat mid-section 38; a second curved section 40; and an opposite edge flange portion 42; all of which are adhesively or otherwise affixed to the rear panel portion 18 of the file folder.

FIGS. 8, 9, illustrate still another form of reinforcing member of my invention wherein the member designated generally at 25 is formed of resilient sheet material which is pre-set in a parallel grooved configuration so as to provide a plurality of parallel vertically running ridges 46. Also note that in this case by way of example the reinforcing member 25 is shown as being coextensive at its upper end with the width of the index tab portion 24 of the folder.

FIG. 10 illustrates still another form of reinforcing arrangement for the folder wherein a variety of plan form shapes for the reinforcing member may be provided. In each case the member is formed of resilient sheet material having the edge flange portions adhesively attached to the rear panel 18 of the folder. At their upper ends the members extend above the upper edge of the folder panel 18 and are laterally enlarged so as to provide convenient index tab devices. As shown at the left hand side portion of FIG. 10, a left-hand L-shaped member as is designated generally at 50 may be adhesively affixed to the rear panel 18; the index tab portion 52 thereof being thus arranged to extend still further to the left. Similarly, a T-shaped member as indicated generally at 60 may be affixed as explained hereinabove to the folder panel, so that the laterally enlarged index tab portion 62 thereof extends above the top edge of the folder panel 18. Similarly, a right-handed L-shaped member as designated generally at 70 may be adhesively affixed at any desired location on the folder panel 18 in such manner that its index tab portion 72 extends still further toward the right. Thus, complete maximum utilization of the index tab space across the top of the folder is available. As shown, the upper end portions 52, 62, 72, of the members 50, 60, 70, may be of the "open window" type and back-walled to support therein a slide-fitted index label slip.

FIG. 11 illustrates how a reinforcing member of the invention may be employed to vertically stiffen a relatively thin and inexpensive fabricated file drawer "divider", and at the same time provide a top end index tab portion and a bottom end extension which is suitably perforated to receive a conventionally employed filing drawer hold-down or "follower" rod. Furthermore, as shown at FIG. 11, a plurality of such reinforcing members for this purpose may be provided as indicated at 80, 82, 84, of variously shaped forms at their upper ends in that they are slanted off at different angles to enable the members to be affixed to the divider panel 18 so as to vertically reinforce the latter while being disposed to extend at their upper ends beyond the upper edge of the divider at different positions horizontally therealong. Thus, the index tab portions thereof may be readily arranged at any one of a variety of desired horizontal positions relative to the filing drawer contents. Also, as shown in FIG. 11 the upper ends of the members 80, 82, 84, may be of "open-window" form and back-walled, so as to carry index slides therein.

Thus, it will be appreciated that the invention provides improved means for vertically reinforcing the index tab carrying portion of the separator so that at all times the index tabs of a procession of filed materials stand uniformly at their full heights so that each separator label is more readily viewable and access to its subject matter is more readily obtainable.

I claim:

1. A filing material separator for keeping separated segregated correspondence, literature and the like, said separator including:

a vertically standing panel portion formed of relatively thin and limp sheet material and terminating at its upper edge in a file identification carrying portion;

a panel reinforcing member affixed to said panel portion to extend generally vertically thereof and substantially throughout said vertically standing panel and across a selected horizontal width of said panel portion;

said reinforcing member being resilient in directions normal to the plane of said panel portion;

whereby said separator panel is flexible in directions normal to the plane thereof while being maintained by said reinforcing member to stand at its full height and to maintain said file identification carrying portion to be readily visible at a position above the file contents and to facilitate grasping of the separator for removal purposes.

2. A filing material separator as set forth in claim 1 wherein said panel portion integrally adjoins along its bottom edge with a relatively limp upstanding file folder front cover portion.

3. A filing material separator as set forth in claim 1 wherein said reinforcing member is spring-set in corrugated form to increase the vertical stiffness thereof.

4. A filing material separator as set forth in claim 1 wherein said reinforcing member is bent over the upper edge portion of said panel and downwardly therebehind.

5. A filing material separator as set forth in claim 4 wherein said downwardly extending portion of said reinforcing member is rearwardly deformed so as to provide an abutment device operable to space said panel forwardly of any filing material disposed therebehind.

6. A filing material separator as set forth in claim 1 wherein said reinforcing member includes at its upper end portion a lateral extension, thereby providing a horizontally extended top end portion.

7. A filing material separator as set forth in claim 1 wherein said reinforcing member is fabricated to extend below the bottom edge of said panel portion and is perforated to receive therethrough a filing cabinet follower rod or the like.

8. A filing material separator as set forth in claim 7 wherein the upper end portion of said reinforcing member is slanted away from the longitudinal direction thereof, and wherein the main body portion of said reinforcing member is angularly disposed relative to said panel portion and affixed thereto, whereby the slanted upper end portion of said reinforcing member extends flatwise across the top of said panel portion.

* * * * *

UNITED STATES PATENT OFFICE

CERTIFICATE OF CORRECTION

PATENT NO. : 3,999,819

DATED : December 28, 1976

INVENTOR(S) : Kenneth D. Schreyer

It is certified that error appears in the above-identified patent and that said Letters Patent are hereby corrected as shown below:

On the Cover Page, Item [54] should read --- Filing Folders And Dividers ---.

Column 1, line 2, should read --- Filing Folders And Dividers ---.

Column 2, line 44, "lso" should read --- also ---.

Column 2, line 46, after recognition, "/-" should read --- /---.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*